US009672842B2

(12) United States Patent
Yeo

(10) Patent No.: US 9,672,842 B2
(45) Date of Patent: Jun. 6, 2017

(54) TERMINAL, AUDIO DEVICE COMMUNICATING WITH TERMINAL, AND VEHICLE

(71) Applicant: Hyundai Motor Company, Seoul (KR)

(72) Inventor: BuGeun Yeo, Jeollabuk-do (KR)

(73) Assignee: Hyundai Motor Company, Seoul (KR)

( * ) Notice: Subject to any disclaimer, the term of this patent is extended or adjusted under 35 U.S.C. 154(b) by 9 days.

(21) Appl. No.: 14/802,299

(22) Filed: Jul. 17, 2015

(65) Prior Publication Data

US 2016/0163328 A1 Jun. 9, 2016

(30) Foreign Application Priority Data

Dec. 9, 2014 (KR) ..... 10-2014-0175772

(51) Int. Cl.
*G10L 21/0208* (2013.01)
*H04R 3/02* (2006.01)

(52) U.S. Cl.
CPC ..... *G10L 21/0208* (2013.01); *H04R 3/02* (2013.01); *G10L 2021/02082* (2013.01)

(58) Field of Classification Search
CPC ..... G10L 21/0208; H04R 3/02
See application file for complete search history.

(56) References Cited

U.S. PATENT DOCUMENTS 8,224,398 B2 * 7/2012 Kirigaya ..... H04M 1/6083 455/569.1
2010/0035663 A1 * 2/2010 Haulick ..... H04M 1/6083 455/569.2
2010/0041443 A1 * 2/2010 Yokota ..... H04M 1/6083 455/569.2
2010/0151833 A1 * 6/2010 Azuma ..... H04M 1/6091 455/412.2

(Continued)

FOREIGN PATENT DOCUMENTS

JP 2004040161 A 2/2004
KR 10-2001-0000166 A 1/2001

(Continued)

OTHER PUBLICATIONS

Korean Office Action for Korean Application No. 10-2014-0175772, English translation, 21 pages.

(Continued)

*Primary Examiner* — Brenda Bernardi
(74) *Attorney, Agent, or Firm* — Mintz Levin Cohn Ferris Glovsky and Popeo, P.C.; Peter F. Corless

(57) ABSTRACT

A terminal includes: a communication unit configured to communicate with a hands-free device and an audio device provided in a place in which speech is produced; and a control unit configured to perform control such that: i) when a filter generation mode is selected, a test signal is generated, ii) when a microphone signal transmitted from the hands-free device is received, the received microphone signal and the generated test signal are mixed, and the mixed signal is (Continued)

transmitted to the audio device, and iii) when a feedback signal transmitted from the hands-free device is received, a sound feedback removing filter is generated based on the received feedback signal, and the generated sound feedback removing filter is transmitted to the audio device.

9 Claims, 19 Drawing Sheets

(56) References Cited

U.S. PATENT DOCUMENTS

| | | | | |
|---|---|---|---|---|
| 2010/0233998 | A1* | 9/2010 | Saito | H04M 1/72552 455/412.2 |
| 2014/0254825 | A1* | 9/2014 | Tahernezhadi | H04R 3/02 381/93 |
| 2015/0031288 | A1* | 1/2015 | Tubbesing | H04W 4/008 455/41.1 |

FOREIGN PATENT DOCUMENTS

| | | | |
|---|---|---|---|
| KR | 10-2006-0023235 | | 3/2006 |
| KR | 10-0633985 | | 10/2006 |
| KR | 10-0747330 | B1 | 8/2007 |
| KR | 10-2011-0076520 | A | 7/2011 |
| KR | 10-1413737 | | 6/2014 |

OTHER PUBLICATIONS

Notice of Allowance from Korean Intellectual Property Office for Korean Application No. 10-2014-0175772, dated Jun. 24, 2016, English summary, 7 pages.

* cited by examiner ( 131: 131a, 131b, 131c, 131d )

TERMINAL, AUDIO DEVICE COMMUNICATING WITH TERMINAL, AND VEHICLE

CROSS-REFERENCE TO RELATED APPLICATION

This application claims priority to and the benefit of Korean Patent Application No. 10-2014-0175772, filed on Dec. 9, 2014 in the Korean Intellectual Property Office, the disclosure of which is incorporated herein in its entirety by reference.

BACKGROUND

1. Technical Field

Embodiments of the present disclosure relate to a terminal configured to receive and output a user's sound, an audio device communicating with the terminal, and a vehicle.

2. Description of the Related Art

As is well known in the art, an audio device can output sound waves within a sound range audible to humans, as well as an electrical signal converted from such sound waves. Audio devices may be provided in indoor places, such as a home, a vehicle, or an auditorium, or outdoor places, such as a playground.

Typically, audio devices receive a sound input (e.g., through a microphone), store audio data (e.g., in a terminal, a recording medium, and the like), and output the received audio data (e.g., through a speaker and the like). In addition, audio devices typically receive a sound signal input to the microphone in an area (e.g., indoors or outdoors), perform signal processing on the signal, and output the result (e.g., through a speaker). However, a problem can arise in that sound output from the speaker is input to the microphone again, causing sound feedback to occur. Consequently, the user's sound is not properly delivered.

SUMMARY

The present disclosure provides a terminal for generating a sound feedback removing filter corresponding to an environment of a place in which speech is produced, and a vehicle and an audio device communicating with the terminal. The present disclosure also provides an audio device for outputting a sound signal in which a sound feedback frequency is removed and a vehicle having the same.

According to embodiments of the present disclosure, there is provided a terminal, including: a communication unit configured to communicate with a hands-free device and an audio device provided in a place in which speech is produced; and a control unit configured to perform control such that: i) when a filter generation mode is selected, a test signal is generated, ii) when a microphone signal transmitted from the hands-free device is received, the received microphone signal and the generated test signal are mixed and the mixed signal is transmitted to the audio device, and iii) when a feedback signal transmitted from the hands-free device is received, a sound feedback removing filter is generated based on the received feedback signal, and the generated sound feedback removing filter is transmitted to the audio device.

The communication unit may include a first profile, a second profile, and a third profile, and the control unit may be further configured to pair with the hands-free device using the first profile and pair with the audio device using the second profile and the third profile.

The first profile may include a hands-free profile (HFP), the second profile may include an advanced audio distribution profile (A2DP), and the third profile may include a file transfer profile (FTP).

The control unit may be further configured to convert the feedback signal into a level of a frequency domain, compare the converted level to a reference level, identify a frequency whose converted level is the reference level or greater, and generate the sound feedback removing filter by summing the identified frequency.

The terminal may further include an input unit configured to receive a selection of the filter generation mode; and a sound input unit configured to receive a sound signal in the place in which speech is produced. The control unit may be further configured to perform control such that: i) when the filter generation mode is selected, it is determined whether the microphone signal and a sound signal transmitted from the hands-free device are received, ii) when it is determined that the microphone signal and the sound signal are received, the received microphone signal and sound signal are mixed, and the mixed signal is transmitted to the audio device, and iii) when the feedback signal transmitted from the hands-free device is received, the sound feedback removing filter is generated based on the received feedback signal.

The terminal may further include a storage unit configured to store the generated sound feedback removing filter and store, by mapping, a generation time of the sound feedback removing filter and a name of the place in which speech is produced.

Furthermore, according to embodiments of the present disclosure, there is provided a terminal, including: a communication unit configured to communicate with a hands-free device and an audio device provided in a place in which speech is produced; a control unit configured to perform control such that: i) when a filter generation mode is selected, a test signal is generated, ii) when a microphone signal transmitted from the hands-free device is received, the received microphone signal and the generated test signal are mixed and the mixed signal is transmitted to the audio device, iii) when a feedback signal transmitted from the hands-free device is received, a sound feedback removing filter is generated based on the received feedback signal, and iv) when a speech mode is selected, filtering of the sound signal transmitted from the hands-free device is performed using the sound feedback removing filter, and the filtered sound signal is transmitted to the audio device; and a storage unit configured to store the sound feedback removing filter.

The communication unit may include a first profile having a hands-free profile (HFP) and a second profile having an advanced audio distribution profile (A2DP), and the control unit may be further configured to pair with the hands-free device using the first profile and pair with the audio device using the second profile.

The control unit may be further configured to convert the feedback signal into a level of a frequency domain, compare the converted level and a reference level, identify a frequency whose converted level is the reference level or greater, and generate the sound feedback removing filter using the identified frequency.

Furthermore, according to embodiments of the present disclosure, there is provided a terminal, including: a communication unit configured to communicate with an audio device provided in a place in which speech is produced; a sound input unit configured to receive a sound signal of the place in which speech is produced; and a control unit configured to perform control such that: i) when a filter generation mode is selected, a test signal is generated, a microphone signal and the generated test signal are mixed, and the mixed signal is transmitted to the audio device, and ii) when a feedback signal is received in the sound input unit, a sound feedback removing filter is generated based on the received feedback signal, and the generated sound feedback removing filter is transmitted to the audio device.

The communication unit may include an advanced audio distribution profile (A2DP) and a file transfer profile (FTP) and the control unit may be further configured to transmit the mixed signal to the audio device using the advanced audio distribution profile (A2DP) and transmit the sound feedback removing filter to the audio device using the file transfer profile (FTP).

The control unit may be further configured to convert the feedback signal into a level of a frequency domain, compare the converted level to a reference level, identify a frequency whose converted level is the reference level or greater, and generate the sound feedback removing filter by summing the identified frequency.

Furthermore, according to embodiments of the present disclosure, there is provided an audio device, including: a communication unit configured to communicate with a terminal in a place in which speech is produced; a control unit configured to perform control such that, when a mixed signal transmitted from the terminal in a filter generation mode is received, an output of the mixed signal is controlled, and storage of a sound feedback removing filter transmitted from the terminal is controlled, and ii) when a sound signal transmitted from the terminal in a speech mode is received, filtering of the received sound signal is performed using the stored sound feedback removing filter and an output of the filtered sound signal is controlled; a storage unit configured to store the sound feedback removing filter; an amplification unit configured to amplify the mixed signal and the sound signal; and a speaker configured to output the amplified mixed signal and sound signal.

The communication unit may include an advanced audio distribution profile (A2DP) and a file transfer profile (FTP), and the control unit may be further configured to perform control such that the mixed signal is received using the advanced audio distribution profile (A2DP), and the sound feedback removing filter is received using the file transfer profile (FTP).

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION OF THE EMBODIMENTS

Figure 1:
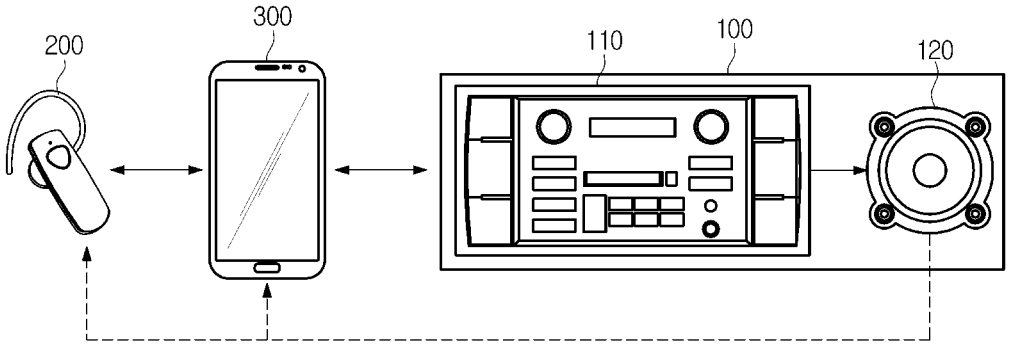
FIG. 1 is an exemplary diagram illustrating a terminal, a hands-free device communicating with the terminal, and an audio device according to embodiments of the present disclosure.

Hereinafter, exemplary embodiments of the present disclosure will be described in detail with reference to the accompanying drawings. As those skilled in the art would realize, the described embodiments may be modified in various different ways, all without departing from the spirit or scope of the present disclosure. Further, throughout the specification, like reference numerals refer to like elements.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

Additionally, it is understood that one or more of the below methods, or aspects thereof, may be executed by at least one control unit. The term "control unit" may refer to a hardware device that includes a memory and a processor.

The memory is configured to store program instructions, and the processor is specifically programmed to execute the program instructions to perform one or more processes which are described further below. Moreover, it is understood that the below methods may be executed by an apparatus comprising the control unit in conjunction with one or more other components, as would be appreciated by a person of ordinary skill in the art.

Hereinafter, the present disclosure will be described in detail with reference to the accompanying drawings.

FIG. 1 is an exemplary diagram illustrating a terminal, a hands-free device communicating with the terminal, and an audio device according to embodiments of the present disclosure.

An audio device 100 includes a main body 110 configured to perform signal processing on an input audio signal and sound signal and amplification and a speaker 120 configured to output a signal transmitted from the main body 110. Here, the main body 110 and the speaker 120 may be integrally or separated provided. The audio device 100 reads a sound signal input to a microphone, data stored in a terminal 300 and a storage medium such as an optical disc and a memory, outputs an audio signal corresponding to the read audio data, or outputs an audio signal of a radio. The audio device 100 may perform wireless communication such as Bluetooth and also perform wired communication. The audio device 100 communicates with the terminal 300 and receives a sound signal, an audio signal and the like from the terminal 300.

A hands-free device 200 performs wired and/or wireless communication with the terminal 300 and transmits and receives a sound signal to and from the terminal 300. The hands-free device 200 receives a sound, transmits a sound signal of the received sound to the terminal 300, or receives a sound signal transmitted from the terminal 300, and outputs the result. The terminal 300 performs pairing with the hands-free device 200 and the audio device 100 and performs wired and/or wireless communication with the paired hands-free device 200 and audio device 100. Also, when the terminal 300 performs wired and/or wireless communication with the audio device 100, the terminal 300 transmits a sound signal, an audio signal and an operation control signal to the audio device 100.

The terminal 300 performs wired and/or wireless communication with the hands-free device 200 and transmits and receives a sound signal to and from the hands-free device 200. Also, the terminal 300 receives a sound signal, a microphone signal and a feedback signal from the hands-free device 200 when a filter is manually generated. The terminal 300 receives a feedback signal and a microphone signal from the hands-free device 200 when the filter is automatically generated. In addition, the terminal 300 includes the microphone, and may directly receive the user's sound signal and the feedback signal in a manual filter generation mode.

Figure 2:
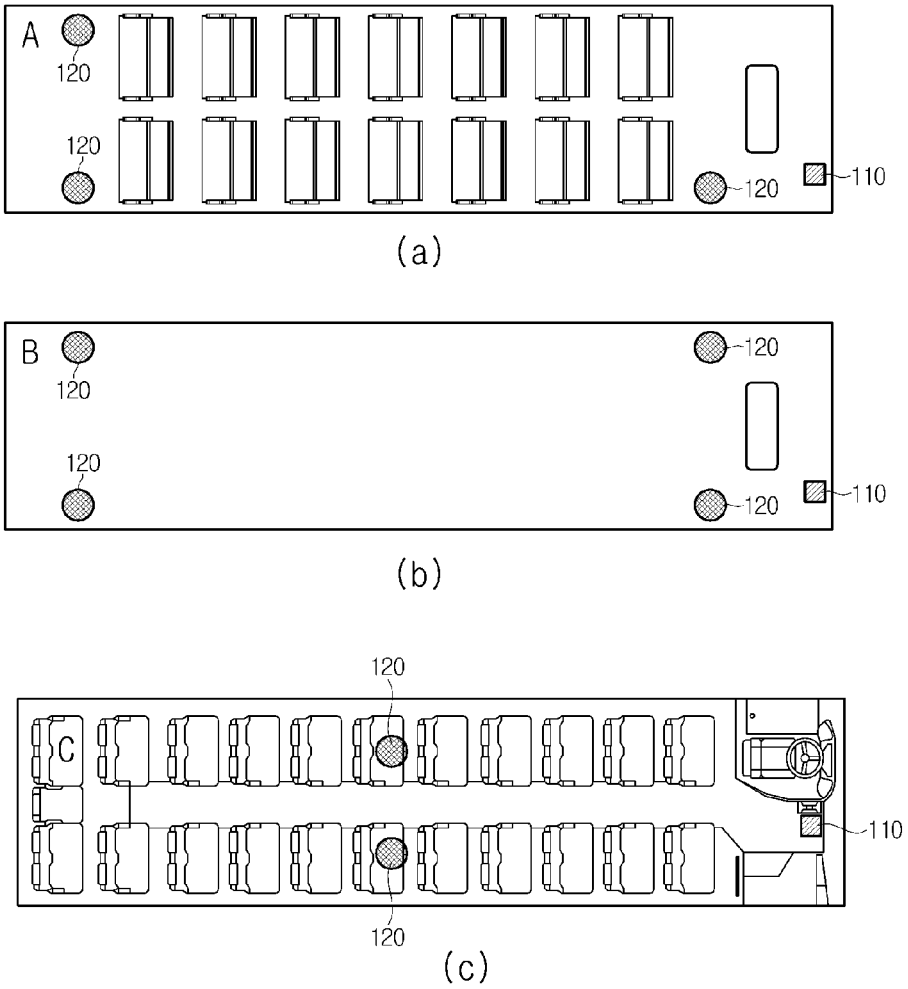
FIG. 2 shows exemplary diagrams illustrating a disposition space of a terminal and an audio device communicating with the terminal according to embodiments of the present disclosure.

In this manner, the audio device, the terminal and the hands-free device that communicate to each other are connected to each other while located at the same place in which speech is produced, receive a sound and output the received sound, and may output a sound in which sound feedback is removed by the terminal. For example, as illustrated in FIG. 2A, the terminal 300 may perform wired and/or wireless communication with the audio device 100 (110 and 120) provided in an indoor place such as an auditorium A and remove sound feedback of a sound output through the audio device when speech is produced in the auditorium A. In addition, as illustrated in FIG. 2B, the terminal 300 may perform wired and/or wireless communication with the audio device 100 (110 and 120) provided in an outdoor place such as a playground B and remove sound feedback of a sound output through the audio device when speech is produced in the playground B. In addition, as illustrated in FIG. 2C, the terminal 300 may perform wired and/or wireless communication with the audio device 100 (110 and 120) provided in a movable indoor place such as a bus C and remove sound feedback of a sound output through the audio device when speech is produced in the bus C. That is, the terminal 300 may perform wired and/or wireless communication with the audio device that is disposed in a place in which speech is produced using the microphone and enable a sound signal in which sound feedback is removed to be output from the audio device.

The microphone may be a microphone that is disposed in the hands-free device or the terminal. In addition, the place in which speech is produced has an environment condition in which sound feedback may occur when speech is produced using the microphone. For example, in the auditorium, an auditorium wall, a chair, a table, and the like may be an environment condition in which sound feedback occurs. In the playground, a distance between a main body and a speaker and the like may be an environment condition in which sound feedback occurs. In the bus, an inside chair and the like may be an environment condition in which sound feedback occurs.

Accordingly, the terminal 300 uses the hands-free device 200, detects a sound feedback frequency of a place in which speech is produced and the audio device 100 is disposed, and generates a sound feedback removing filter for removing the detected sound feedback frequency. Hereinafter, the terminal for removing sound feedback of a sound output from the audio device 100 in a vehicle when the sound is output using the audio device 100 provided in the vehicle and the hands-free device 200 communicating with the terminal will be exemplified.

Figure 3:
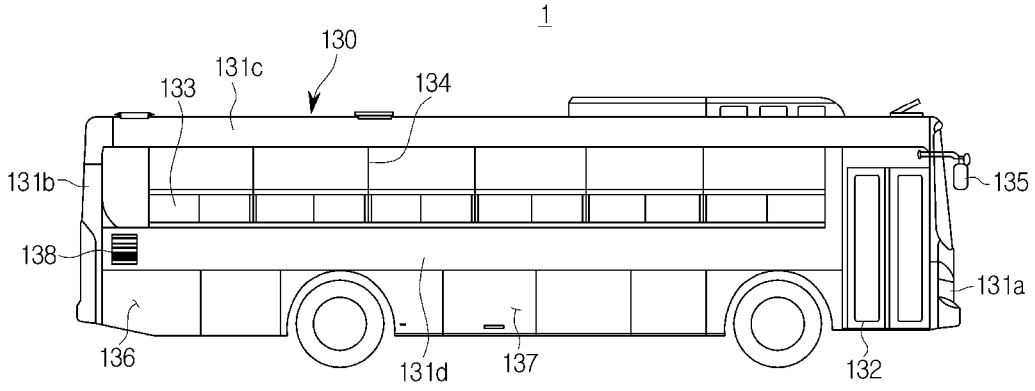
FIG. 3 is a diagram illustrating an exemplary exterior of a vehicle in which an audio device communicating with a terminal is provided according to embodiments of the present disclosure.
Figure 4:
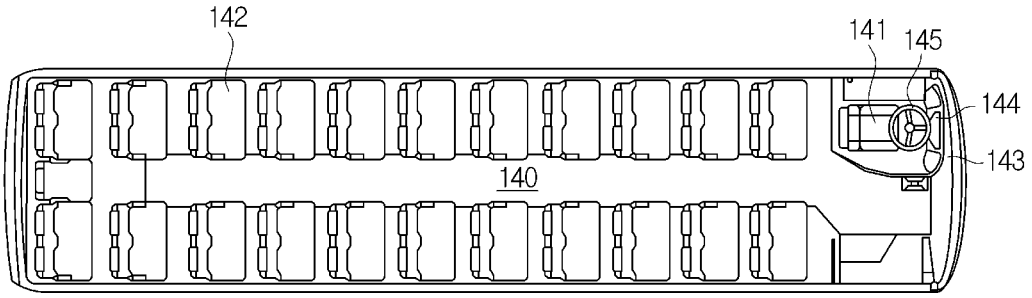
FIG. 4 is a diagram illustrating an exemplary interior of a vehicle in which an audio device communicating with a terminal is provided according to embodiments of the present disclosure.
Figure 5:
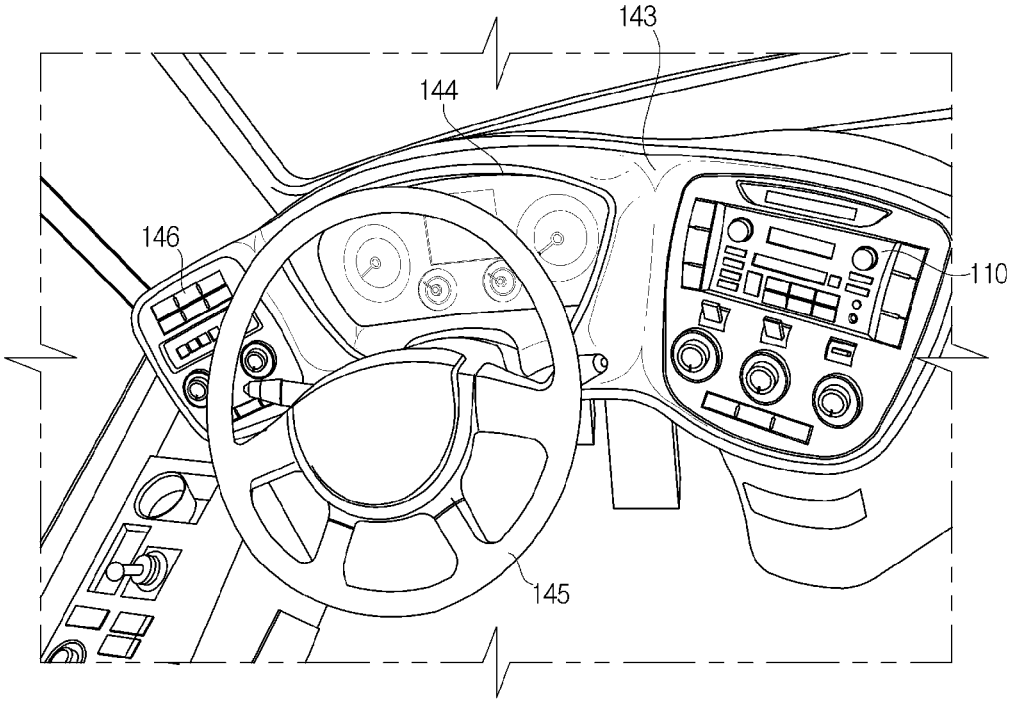
FIG. 5 is a diagram illustrating an exemplary driver's seat inside a vehicle in which an audio device communicating with a terminal is provided according to embodiments of the present disclosure.

FIG. 3 is a diagram illustrating an exemplary exterior of a vehicle in which an audio device communicating with a terminal is provided according to embodiments of the present disclosure; FIG. 4 is a diagram illustrating an exemplary interior of a vehicle in which an audio device communicating with a terminal is provided according to embodiments of the present disclosure; FIG. 5 is a diagram illustrating an exemplary driver's seat inside a vehicle in which an audio device communicating with a terminal is provided according to embodiments of the present disclosure.

As illustrated in FIG. 3, the vehicle 1, for example, may be a bus, which can carry more people than a car. The vehicle 1 includes a body including an interior part and an exterior part and a chassis that is the remaining part after excluding the body and in which a mechanical device necessary for driving is installed.

An exterior part 130 of the body includes a frame that forms a skeleton and supports a load on the body and a panel 131 that surrounds an exterior of the frame. Here, the panel 131 includes a front panel 131*a*, a rear panel 131*b*, a roof panel 131*c* and a side panel 131*d*. The exterior part of the vehicle includes a door 132 that is disposed between the front panel 131*a* and the side panel 131*d* and forms a passage through which a passenger gets on or off. In addition, the door 132 may be further formed at a side panel in a rear side of the vehicle. The exterior part of the vehicle further includes glass windows 133 that are disposed at the door 132, the front panel 131*a* and the side panel 131*d*, and pillars 134 that are provided at a boundary among the glass windows 133. The exterior part of the body further includes a side mirror 135 configured to provide a rear view of the vehicle 1 to a driver and the like.

An engine compartment 136 in which an engine is accommodated and a cargo compartment 137 into which goods are loaded are formed in a lower part of the body of the vehicle. The engine compartment 136 and the cargo compartment 137 may be closed and opened by separate doors. Also, the vehicle further includes an engine air inlet 138 that is formed in the side panel 131*d* and guides external air to the engine compartment 136. Also, the vehicle further includes a headlight that is provided at the front panel 131*a* and illuminates a road ahead and a tail light that is provided at the rear panel 131*b* and illuminates a road behind.

The chassis of the vehicle further includes a power generating device, a power delivering device, a driving device, a steering device, a braking device, a suspension device, a transmission device, a fuel device, front, rear, left and right wheels, and the like.

The vehicle 1 includes an electronic control unit (ECU) configured to control driving of the power generating device, the power delivering device, the driving device, the steering device, the braking device, the suspension device, the transmission device, the fuel device, several safety devices and various sensors. Also, the vehicle 1 may selectively include an electronic device such as the hands-free device 200, a GPS, the audio device 100, a Bluetooth device, a rear view camera, a charging device, a high-pass device, and a navigation device, which are devices for the driver's convenience.

The vehicle 1 further includes a battery (not illustrated) that is electrically connected to an indoor lighting device, a starter motor and electronic devices and supplies driving power. The battery performs charging using a self-generator or power of the engine while driving.

As illustrated in FIG. 4, an interior part 140 of the body includes a driver's seat 141 on which a driver sits, a plurality of passengers' seats 142 on which a passenger other than the driver sits, a dashboard 143, a cluster (i.e., an instrument panel 144) that is disposed on the dashboard 143 and guides a driving function such as a vehicle speed, an engine RPM, an amount of oil, and a coolant and vehicle information, and a steering wheel 145 configured to manipulate a vehicle direction. More specifically, the plurality of passengers' seats 142 are arranged in a line at both sides inside the vehicle and arranged to form an aisle in a central area of an inside of the vehicle.

As illustrated in FIG. 5, the dashboard 143 includes a head unit 146 in which buttons for controlling an indoor lighting device, an air conditioning unit, a Bluetooth device, door opening and closing, and the like are provided. The main body 110 of the audio device 100 for outputting a sound is provided in the dashboard 143. The cluster 144 may be implemented as a digital type. The digital type cluster displays vehicle information and driving information as an image.

The vehicle 1 further includes the speaker 120 configured to output a sound corresponding to a sound signal transmitted from the audio device 100. A plurality of speakers 120 may be provided and disposed at predetermined positions inside the vehicle.

In the vehicle, the hands-free device 200 configured to receive the user's sound and the terminal 300 configured to remove sound feedback of a sound signal output from the audio device 100 may be disposed. Therefore, the sound feedback removing filter appropriate for the vehicle may be generated using the terminal, and when speech is produced in the vehicle, sound feedback of an input sound signal may be removed using the sound feedback removing filter, and a sound signal in which sound feedback is removed may be output through the speaker of the audio device.

Figure 6:
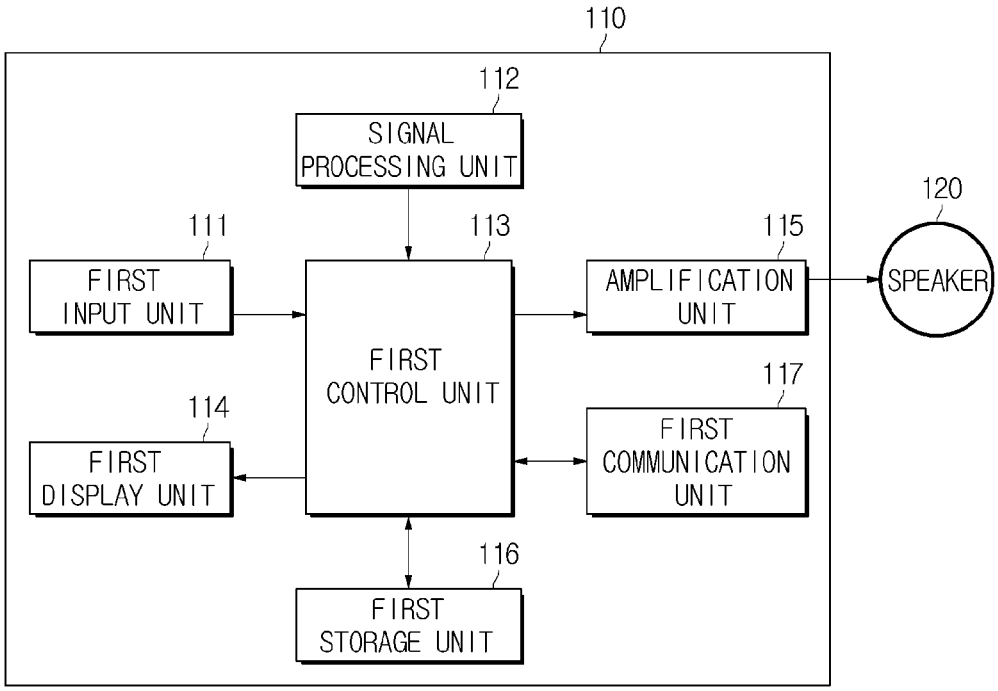
FIG. 6 is a control configuration diagram of an audio device communicating with a terminal according to embodiments of the present disclosure.

A control configuration of the audio device 100, the hands-free device 200 and the terminal 300 will be described in detail with reference to FIGS. 6 to 8. FIG. 6 is a control configuration diagram of an audio device communicating with a terminal according to embodiments of the present disclosure. The audio device includes the main body 110 and the speaker 120.

The main body 110 of the audio device includes a first input unit 111, a signal processing unit 112, a first control unit 113, a first display unit 114, an amplification unit 115, a first storage unit 116 and a first communication unit 117. The first input unit 111 receives an operation command from the user. The first input unit 111 may include a plurality of buttons for selecting audio reproduction, pause, volume control, previous/next song, and the like, may include a power on and off button and a setting button for pairing, and may include a mode selection button for selecting an announcement mode, a call mode and an audio reproduction mode.

The signal processing unit 112 performs signal processing on a sound signal transmitted from the terminal 300. The signal processing unit 112 includes a digital signal processing unit (DSP) configured to convert a received sound signal into a digital signal. Here, the sound signal includes a sound signal input to the hands-free device 200, a mixed signal for generating the sound feedback removing filter, and an audio signal for music or content. Also, the mixed signal is a signal in which a test signal and a microphone signal of the microphone of the hands-free device are mixed.

When a signal of the setting button is input, the first control unit 113 sets pairing with the terminal 300. The first control unit 113 controls an output of the received mixed signal when an operation mode is a filter generation mode, and controls storing of the received sound feedback removing filter when the sound feedback removing filter transmitted from the terminal 300 is received. The first control unit 113 determines whether a sound signal transmitted from the terminal 300 is received when the operation mode is in a speech mode, and when it is determined that the sound signal is received, controls an output of the received sound signal, performs filtering in which a sound feedback frequency of the received sound signal is removed using the sound feedback removing filter stored in the first storage unit 116, and controls an output of the filtered sound signal. The first control unit 113 determines whether the filtered sound signal is received from the terminal 300 while the operation mode is the speech mode, and when it is determined that the filtered sound signal is received from the terminal 300, may perform control such that the filtering operation is not performed and the received sound signal is output.

While paring with the hands-free device 200 is performed in the speech mode, the first control unit 113 may also control an output of a sound signal transmitted from the hands-free device 200. The first control unit 113 controls an audio reproduction operation when a signal of a reproduction button is input and stops or pauses a reproduction operation when a signal of a stop or pause button is input. When the audio signal transmitted from the terminal 300 is received in the audio reproduction mode, the first control unit 113 controls an output of the received audio signal, and performs stop control of an output of the sound signal in the call mode. When the operation control signal is received from the terminal 300, the first control unit 113 controls operations of the first display unit 114 and the amplification unit 115 based on the received operation control signal.

The first display unit 114 displays a current operation mode, displays information on a song that is being reproduced, and displays a plurality of icons for reproduction operation control.

The amplification unit 115 amplifies a sound signal such as the mixed signal, the filtered sound signal, and the signal-processed audio signal to a predetermined level and transmits the amplified sound signal to the speaker 120.

The first storage unit 116 stores the sound feedback removing filter. Here, the sound feedback removing filter includes a band pass filter (BPF). The first storage unit 116 stores information on the paired terminal 300 and hands-free device 200 and stores the operation control signal transmitted from the terminal 300.

The first communication unit 117 includes a wireless communication module, wirelessly communicates with the terminal 300, transmits and receives a sound signal, and receives an audio signal. The wireless communication module includes a Bluetooth communication module.

The Bluetooth communication module selectively includes a first profile, a second profile, a third profile and a fourth profile. The first profile includes a hands-free profile (HPF) for communicating with the hands-free device, the second profile includes an advanced audio distribution profile (A2DP) for transmitting, receiving and controlling an audio signal. The third profile includes a file transfer profile (FTP) for data communication. That is, the audio device performs pairing with the terminal using the second profile and the third profile. The fourth profile includes an audio and video remote control profile (AVRCP) for remotely transmitting the operation control signal such as reproduction, pause, volume control and song selection of previous/next song.

The speaker 120 converts the sound signal transmitted from the amplification unit 115 into a vibration of a vibration plate, generates a compressive wave in air and radiates a sound wave. Accordingly, the user may hear a sound.

Figure 7:
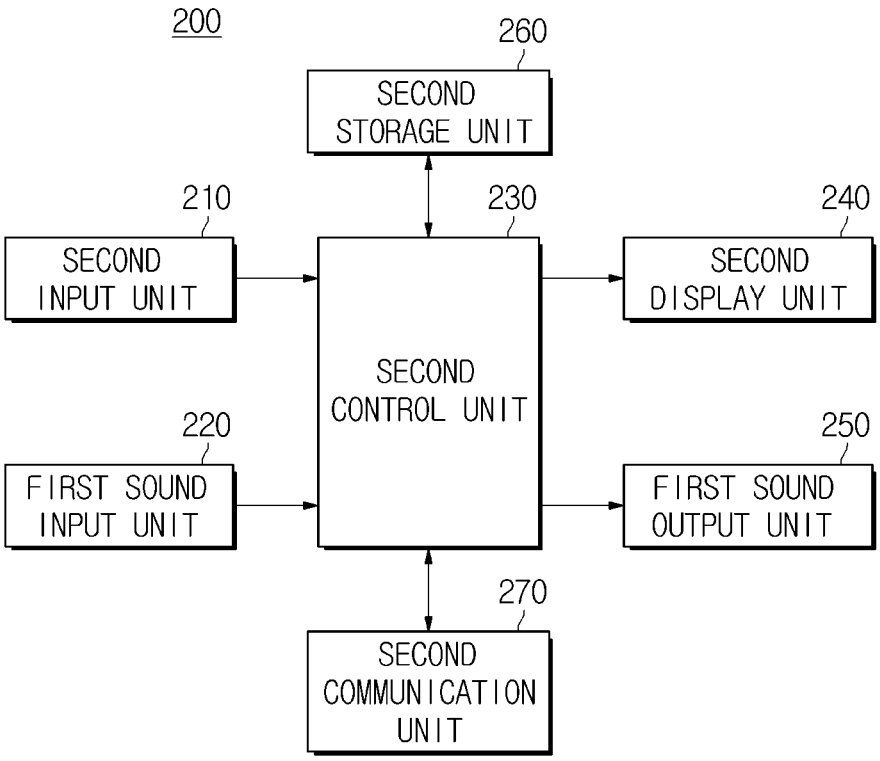
FIG. 7 is a control configuration diagram of a hands-free device communicating with a terminal according to embodiments of the present disclosure.

FIG. 7 is a control configuration diagram of a hands-free device communicating with a terminal according to embodiments of the present disclosure. The hands-free device 200 includes a second input unit 210, a first sound input unit 220, a second control unit 230, a second display unit 240, a first sound output unit 250, a second storage unit 260 and a second communication unit 270.

The second input unit 210 receives an operation command from the user and transmits the received operation command to the second control unit 230. The second input unit 210 may include a power on and off button for receiving a command for power on and off, an adjustment button for volume control, and a pairing button for pairing with the terminal 300 and the audio device 100. In addition, the second input unit 210 may further include a mode selection button for selecting the filter generation mode, the speech mode and the call mode.

The first sound input unit 220 receives the user's sound and transmits a signal corresponding to the received sound to the second control unit 230. The first sound input unit 220 includes a wired or wireless microphone.

The second control unit 230 controls operations of the second display unit 240, the first sound output unit 250 and the second communication unit 270 according to the operation command transmitted from the second input unit 210. When a pairing operation command is received, the second control unit 230 controls pairing with the terminal 300. The second control unit 230 generates a microphone signal of the microphone in the filter generation mode, transmits the generated microphone signal to the terminal 300, receives a sound output from the speaker as a feedback signal, and transmits the received feedback signal to the terminal 300. The second control unit 230 transmits a sound signal input to the first sound input unit in the speech mode to the terminal 300. The second control unit 230 performs control such that a sound signal input to the first sound input unit 220 in the call mode is transmitted to the terminal 300 and the sound signal transmitted from the terminal 300 is output through the first sound output unit 250. The second control unit 230 may control pairing with the audio device 100, and may perform control such that, when pairing with the audio device 100 is performed, the sound signal input to the first sound input unit 220 is transmitted to the audio device 100. The second control unit 230 performs control such that, when a volume control signal input to the second input unit 210 is received, an output level of the received sound signal is adjusted and the sound signal whose level is adjusted is output to the first sound output unit 250.

The second display unit 240 displays operation information corresponding to the control signal transmitted from the second control unit 230. That is, the second display unit 240 may display operation information corresponding to power on and off, a volume level, and a pairing success. The second display unit 240 may include a plurality of light emitting diodes (LEDs).

The first sound output unit 250 outputs the sound signal transmitted from the terminal in the call mode. The first sound output unit 250 may include the speaker.

The second storage unit 260 stores a profile for wireless communication and stores information on a paired device.

The second communication unit 270 includes the wireless communication module, wirelessly communicates with the terminal, and transmits and receives the sound signal.

The wireless communication module includes the Bluetooth communication module. The Bluetooth communication module includes the first profile. The first profile includes a hands-free profile (HFP) for transmitting, receiving, and controlling the sound signal. The second communication unit 270 may also wirelessly communicate with the audio device.

Figure 8:
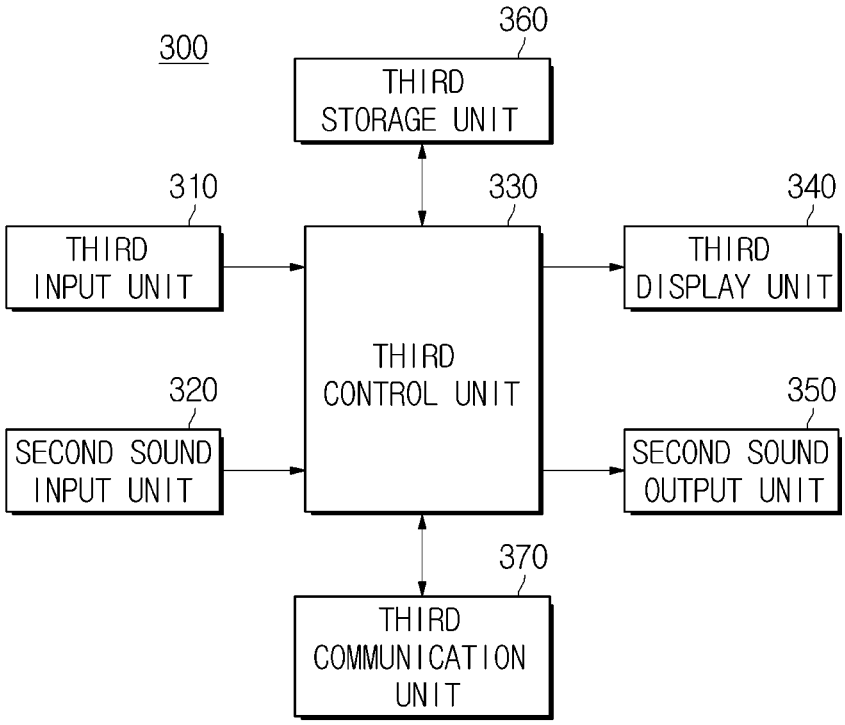
FIG. 8 is a control configuration diagram of a terminal according to embodiments of the present disclosure.

FIG. 8 is a control configuration diagram of a terminal according to embodiments of the present disclosure. The terminal may include a smartphone, a tablet, a notebook and the like. The terminal 300 includes a third input unit 310, a second sound input unit 320, a third control unit 330, a third display unit 340, a second sound output unit 350, a third storage unit 360 and a third communication unit 370.

The third input unit 310 receives an operation command from the user and transmits the received operation command to the third control unit 330. The third input unit 310 includes a power on and off button for receiving a command for power on and off and an adjustment button for volume control. The third input unit 310 may include a setting button for pairing with the hands-free device 200 and the audio device 100, may further include a mode selection button for selecting the filter generation mode, the speech mode, the call mode, the audio reproduction mode and an operation control mode, and may further include a management button for managing the sound feedback removing filter.

The setting button, the management button, and the mode selection button may be displayed as icons on the third display unit 340, and may be selected by a touch signal in this case. When the sound feedback removing filter is generated, the third input unit 310 receives a name of the place in which speech is produced and a generation time thereof. When the sound feedback removing filter is generated, the generation time may be automatically stored.

When the second sound input unit 320 performs the call mode while pairing with the hands-free device 200 is not performed, the second sound input unit 320 receives the user's sound and transmits a signal corresponding to the received sound to the third control unit 330. The second sound input unit 320 includes the microphone.

When a signal of the setting button is received in the third input unit 310, the third control unit 330 performs pairing with the hands-free device 200 and the audio device 100. When pairing with the hands-free device 200 and the audio device 100 is performed, the third control unit 330 performs pairing with the hands-free device 200 using the first profile, and performs pairing with the audio device 100 using the second profile, the third profile and the fourth profile.

Figure 9:
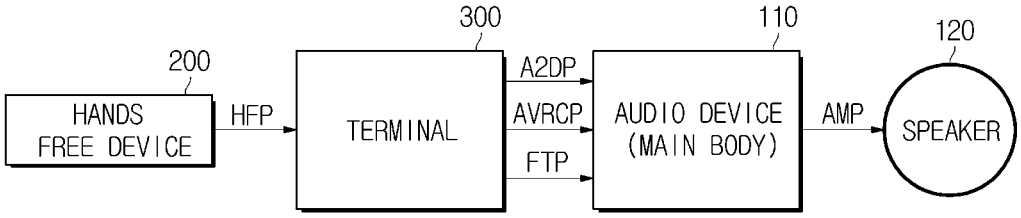
FIG. 9 is a diagram illustrating an exemplary profile in which a terminal, an audio device communicating with the terminal, and a hands-free device are paired according to embodiments of the present disclosure.

As illustrated in FIG. 9, the terminal 300 performs pairing with the hands-free device 200 using the hands-free profile (HFP) for transmitting, receiving and controlling the sound signal, and performs pairing with the audio device 100 using the advanced audio distribution profile (A2DP) for transmitting, receiving and controlling the audio signal, the audio and video remote control profile (AVRCP) for remotely transmitting the operation control signal, and the file transfer profile (FTP) for transmitting and receiving a file. That is, in the filter generation mode, the third control unit 330 enables the microphone signal to be received through the first profile, enables the mixed signal to be transmitted through the second profile, and enables the sound feedback removing filter to be transmitted through the third profile.

In the speech mode, the third control unit 330 performs control such that communication with the hands-free device 200 is performed through the first profile and communication with the audio device 100 is performed through the second profile and the third profile at the same time. Also, the third control unit 330 performs control such that communication with the hands-free device 200 is performed through the first profile in the call mode and communication with the audio device 100 is performed through the second profile and the third profile in the audio reproduction mode.

The third control unit 330 performs any mode based on a signal of the mode selection button input to the third input unit 310. That is, the third control unit 330 performs control such that, when the filter generation mode is selected, a test signal is generated, and when the microphone signal transmitted from the hands-free device 200 is received, the received microphone signal and the generated test signal are mixed, and the mixed signal is transmitted to the audio device 100, and performs control such that, when the feedback signal transmitted from the hands-free device 200 is received, the sound feedback removing filter is generated based on the received feedback signal and the generated sound feedback removing filter is transmitted to the audio device 100. Here, the test signal is a signal having a frequency of 1 Hz to 20 kHz, which is within an audio frequency band audible to humans. The third control unit 330 performs control such that, when a manual mode is selected, a start button of the third display unit is activated, and when the sound signal and the microphone signal transmitted from the hands-free device 200 are received, the received sound signal and microphone signal are mixed and the mixed signal is transmitted to the audio device 100, and performs control such that, when the feedback signal transmitted from the hands-free device 200 is received, the sound feedback removing filter is generated based on the received feedback signal and the generated sound feedback removing filter is transmitted to the audio device 100.

Here, a process of generating the sound feedback removing filter will be described with reference to FIGS. 10 to 12.

Figure 10:
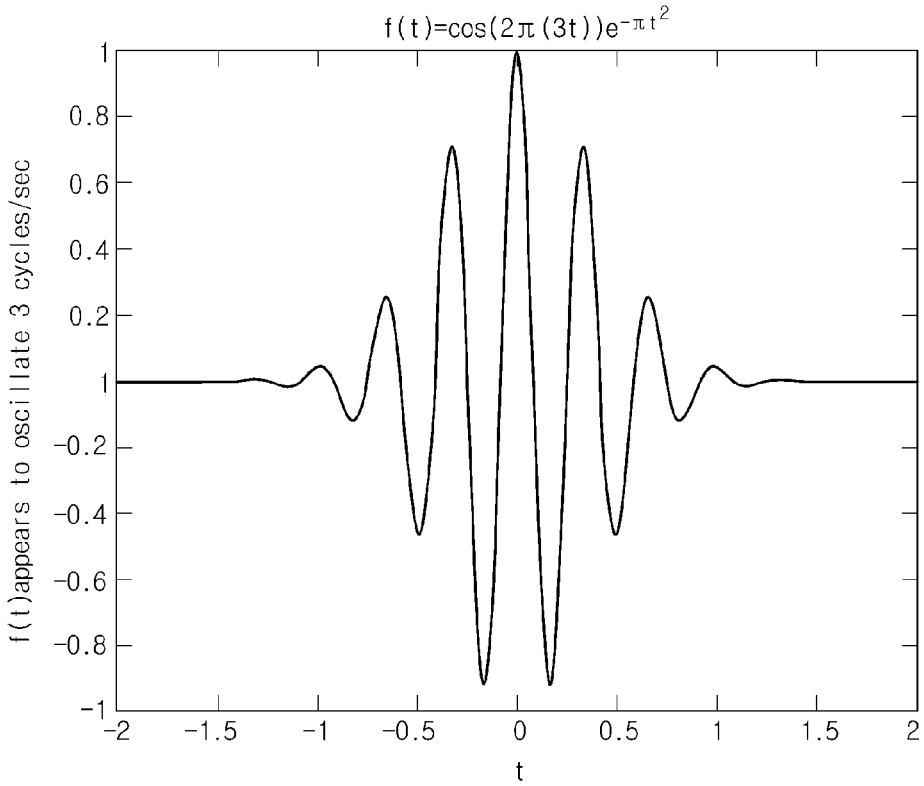
FIGS. 10 to 12 are diagrams illustrating an exemplary process of generating a sound feedback removing filter of a terminal according to embodiments of the present disclosure.

As illustrated in FIG. 10, the third control unit outputs a frequency of the mixed signal over time.

Figure 11:
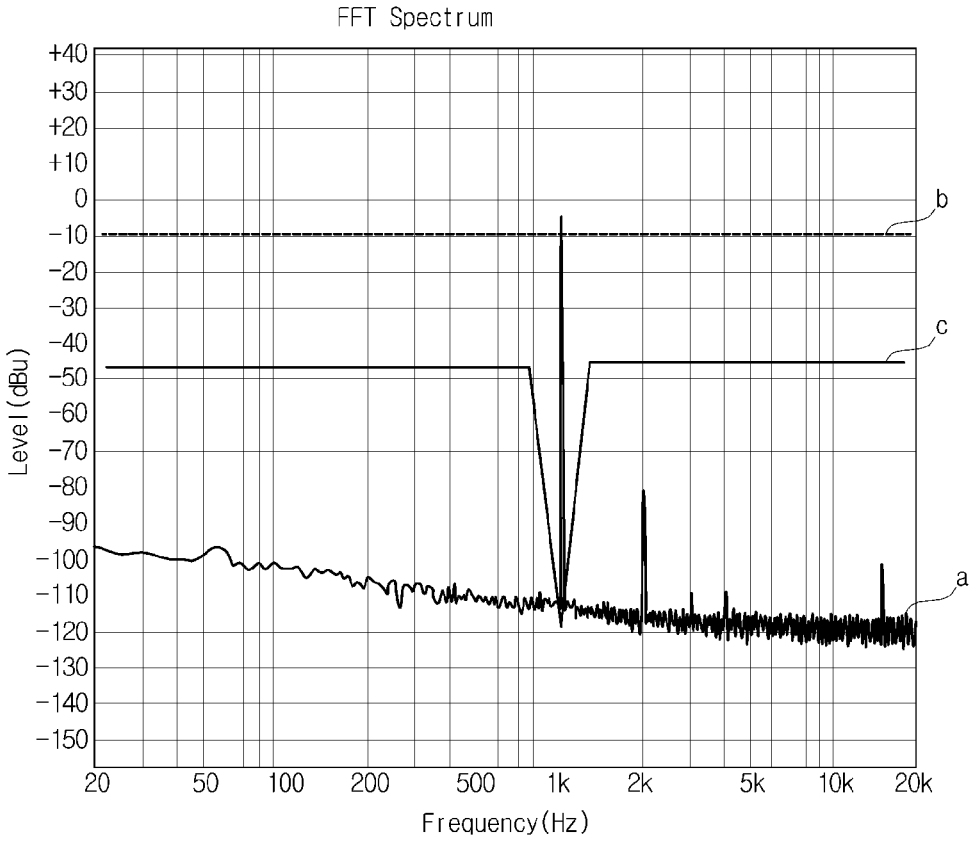

As illustrated in FIG. 11, the third control unit converts the feedback signal transmitted from the hands-free device into a level (dBu) of a frequency domain, compares a converted level a and a reference level b, identifies a frequency whose converted level is the reference level or greater, and generates a filter (BPFi) that rejects the frequency whose converted level is the reference level or greater. A fast Fourier transform (FFT) may be used to convert the feedback signal into a level (dBu) of the frequency domain.

Figure 12:
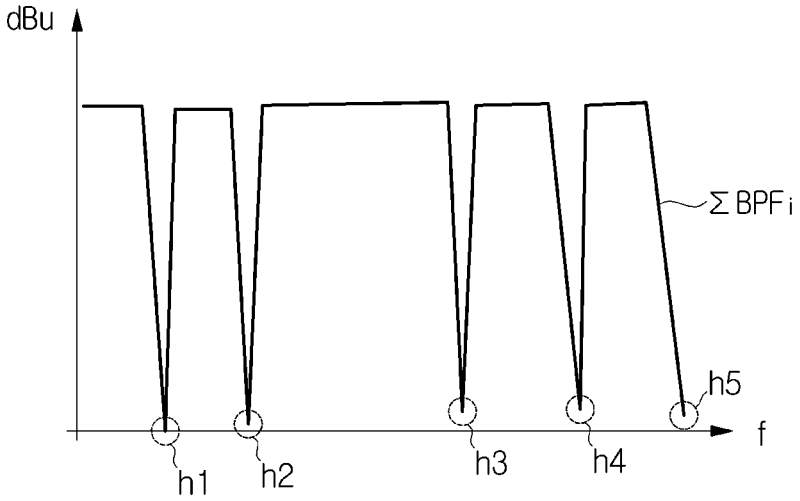

As illustrated in FIG. 12, the third control unit sums all frequencies h1, h2, h3, h4 and h5 that are generated within 1 Hz to 20 kHz of the audio frequency band and have the converted level that is equal to or greater than the reference level, and generates the sound feedback removing filter (ΣBPFi). The feedback signal is a signal that is input to the hands-free device when the mixed signal is amplified and output. The frequencies h1, h2, h3, h4 and h5 having a level that is equal to or greater than the reference level are sound feedback frequencies that cause sound feedback.

The third control unit 330 performs control such that the sound signal transmitted from the hands-free device 200 in the speech mode is received using the first profile and the received sound signal is transmitted to the audio device 100 using the second profile. When there is a program that performs filtering using the sound feedback removing filter, the third control unit 330 may perform control such that the sound signal transmitted from the hands-free device 200 is received using the first profile, the received sound signal is filtered using the sound feedback removing filter, and the filtered signal is transmitted to the audio device 100 using the second profile. The third control unit 330 transmits the operation control signal input to the third input unit 310 in the audio reproduction mode to the audio device 100. The third control unit 330 transmits and receives the sound signal to and from the hands-free device 200 in the call mode, transmits the sound signal transmitted from the hands-free device 200 in the speech mode to the audio device 100, and transmits the audio signal to the audio device 100 in the audio reproduction mode. When a signal of a volume level is input, the third control unit 330 transmits the input signal of the volume level.

The third display unit 340 displays operation information corresponding to the control signal that is transmitted from the third control unit 330. That is, the third display unit 340 displays a pairing screen for setting pairing with the hands-free device 200 and the audio device 100 and displays a current mode, displays a call screen in the call mode, displays a speech screen in the speech mode, and displays an audio reproduction screen corresponding to audio reproduction in the audio reproduction mode. The third display unit 340 may include a flat display panel such as an LCD. The third display unit 340 includes the display panel. The third input unit 310 includes a touch panel disposed at a side of the display panel. In this case, the third input unit 310 and the third display unit 340 may be implemented as a single touch screen.

The second sound output unit 350 outputs a sound when pairing with the hands-free device 200 and the audio device 100 is not performed. The second sound output unit 350 outputs a sound in the call mode and outputs music that is being reproduced in the audio reproduction mode. The second sound output unit 350 includes a speaker.

The third storage unit 360 stores the sound feedback removing filter. The third storage unit 360 may store information on a place in which speech is produced and the sound feedback removing filter is generated and a generation time. The third storage unit 360 stores an audio signal corresponding to at least one song. The third storage unit 360 stores information on the paired hands-free device 200 and audio device 100 and stores current operation information. Here, the current operation information includes operation information such as a volume level, reproduction, stop and pause.

The third communication unit 370 includes the wireless communication module, transmits and receives the sound signal by wirelessly communicating with the hands-free device 200, and transmits the audio signal by wirelessly communicating with the audio device 100. The wireless communication module includes the Bluetooth communication module. The Bluetooth communication module includes the first profile, the second profile, the third profile and the fourth profile.

Figure 13:
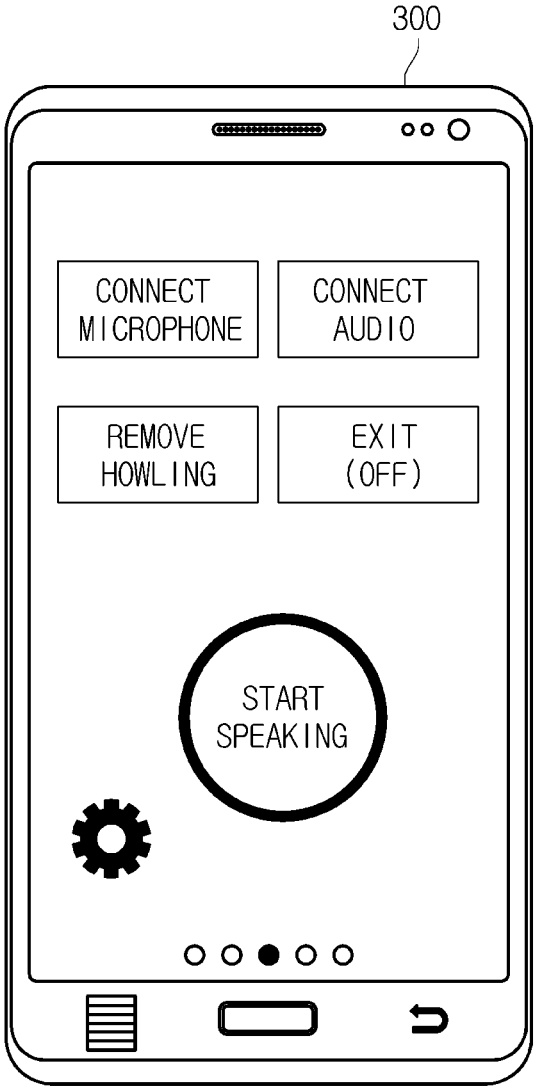
FIGS. 13 to 15 are diagrams illustrating an exemplary display of a terminal according to embodiments of the present disclosure.
Figure 14:
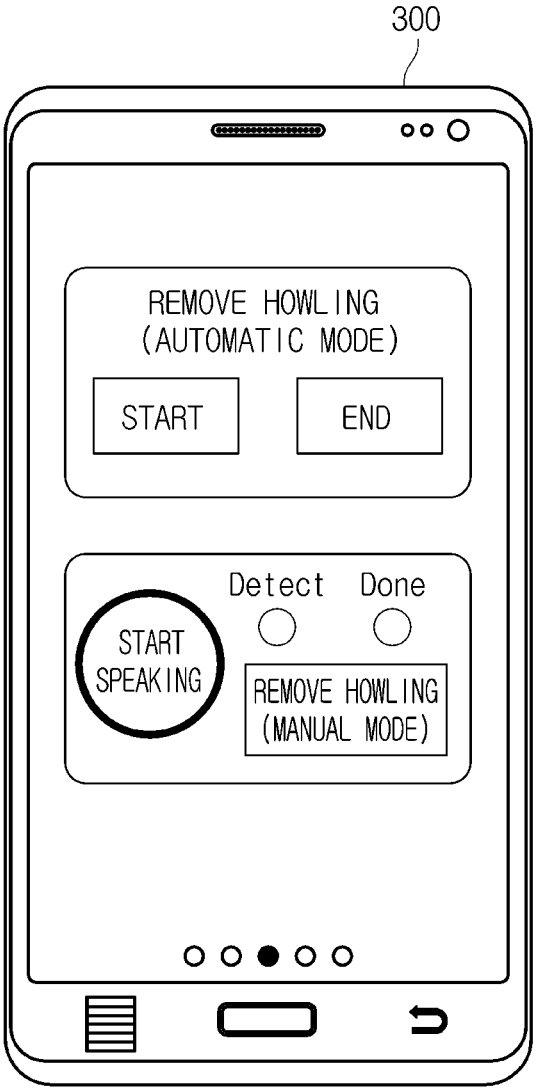
Figure 15:
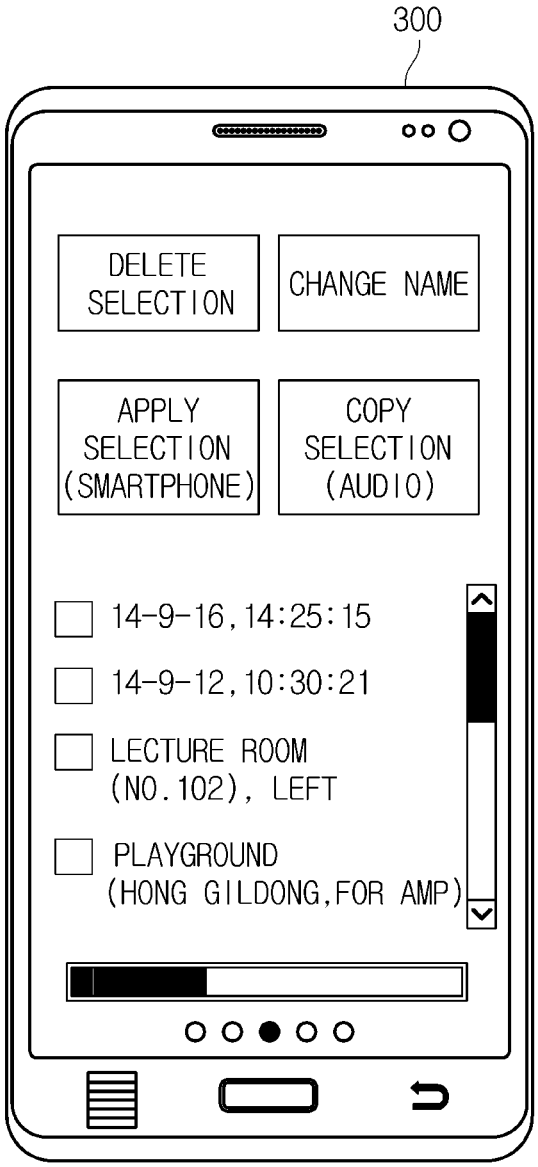

FIGS. 13 to 15 are diagrams illustrating an exemplary display of a terminal according to embodiments of the present disclosure.

As illustrated in FIG. 13, the terminal 300 displays a microphone connection button for pairing with the hands-free device, an audio connection button for pairing with the audio device, a sound feedback removing button for selecting the filter generation mode, and an end button for terminating a connection with the audio device and the hands-free device as icons, and also displays a management button for selecting a management mode for managing a pre-generated sound feedback removing filter as an icon.

As illustrated in FIG. 14, when the sound feedback removing button is touched and selected, the terminal 300 displays an automatic mode button and a manual mode button for generating the sound feedback removing filter.

When the automatic mode is selected, the terminal 300 generates a test signal when a start button is selected, mixes the microphone signal of the hands-free device 200 and the test signal, transmits the mixed signal to the audio device 100, and then generates the sound feedback removing filter using the feedback signal transmitted from the hands-free device 200.

When the manual mode is selected, the terminal 300 activates the microphone of the hands-free device when a speaking start button is selected, mixes the microphone signal and the sound signal transmitted from the hands-free device 200, transmits the mixed signal to the audio device 100, and then generates the sound feedback removing filter using the feedback signal transmitted from the hands-free device 200. In this case, the user may input a sound to the hands-free device while moving within the place in which speech is produced, and may directly input information on a sound input position and a time and store the information.

Accordingly, the terminal 300 may generate the sound feedback removing filter for removing sound feedback in a plurality of positions within the place in which speech is produced. That is, the terminal 300 determines whether sound feedback occurs based on an input sound signal when a sound is input for each of the positions, and when it is determined that sound feedback has occurred, turns a detection lamp (e.g., "Detect") on, and informs the user of sound feedback occurrence. When it is determined that sound feedback has occurred, the terminal 300 identifies a frequency of the occurred sound feedback, generates the sound feedback removing filter, and informs the user of generation completion by turning a lamp (e.g., "Done") on.

As illustrated in FIG. 15, the terminal 300 displays a list of the sound feedback removing filters when the management button is selected, and displays a delete button for deleting at least one sound feedback removing filter selected from the list and a name change button for changing a name of the at least one sound feedback removing filter selected from the list. Also, the terminal may include a selection application button for filtering the sound signal input to the hands-free device in the speech mode and transmitting the filtered sound signal and a selection copy button for transmitting the sound signal input to the hands-free device in the speech mode to the audio device and enabling the signal to be filtered in the audio device. The selection application button may be used when a program for filtering the sound signal using the sound feedback removing filter is stored in the terminal. Also, the selection copy button may be used when the sound feedback removing filter is transmitted to the audio device.

The present disclosure has described a configuration in which the sound feedback removing filter is generated and filtering of the sound signal is performed when a sound is input using the hands-free device. However, when a sound is input using the microphone provided in the terminal, the same configuration of generating the sound feedback removing filter and filtering of the sound signal may be performed.

A connection operation among the hands-free device, the terminal and the audio device in this manner will be described with reference to FIGS. 16 to 19.

Figure 16:
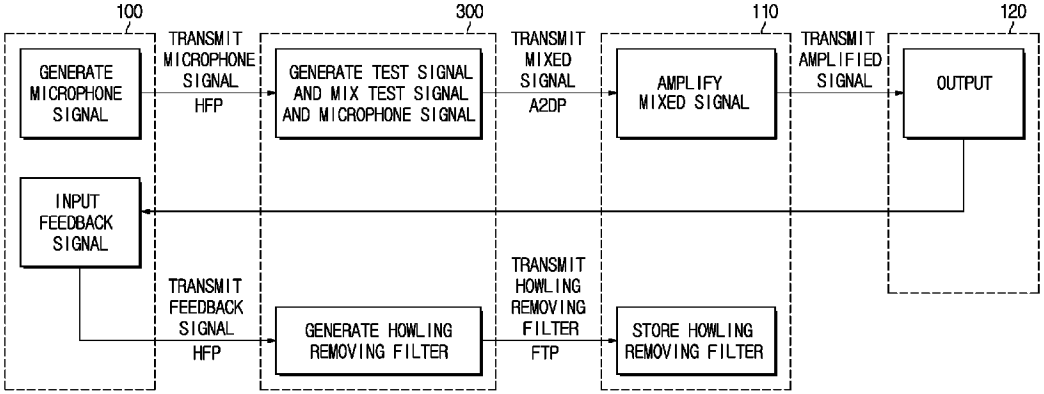
FIGS. 16 to 19 are flowcharts illustrating a connection of a terminal, an audio device communicating with the terminal, and a hands-free device according to embodiments of the present disclosure.

FIG. 16 is a flowchart illustrating generation of the sound feedback removing filter and illustrates a case in which a sound is input using the hands-free device.

The hands-free device 200 generates a microphone signal and transmits the signal to the terminal using the first profile (HFP). The terminal 300 generates a test signal, and when the microphone signal is received using the first profile (HFP), mixes the received microphone signal and the test signal, and transmits the mixed signal that is mixed to the audio device using the second profile (A2DP). When the mixed signal is received, the main body 110 of the audio device amplifies the received mixed signal to a predetermined size and transmits the amplified signal to the speaker 120. The speaker 120 outputs the received signal.

In this case, the sound signal output from the speaker is input to the microphone of the hands-free device 200 as a feedback signal. The hands-free device 200 transmits the input feedback signal to the terminal 300 using the first profile (HFP). The terminal generates the sound feedback removing filter using the received feedback signal and transmits the generated sound feedback removing filter to the main body of the audio device using the third profile (FTP). The audio device stores the received sound feedback removing filter.

Figure 17:
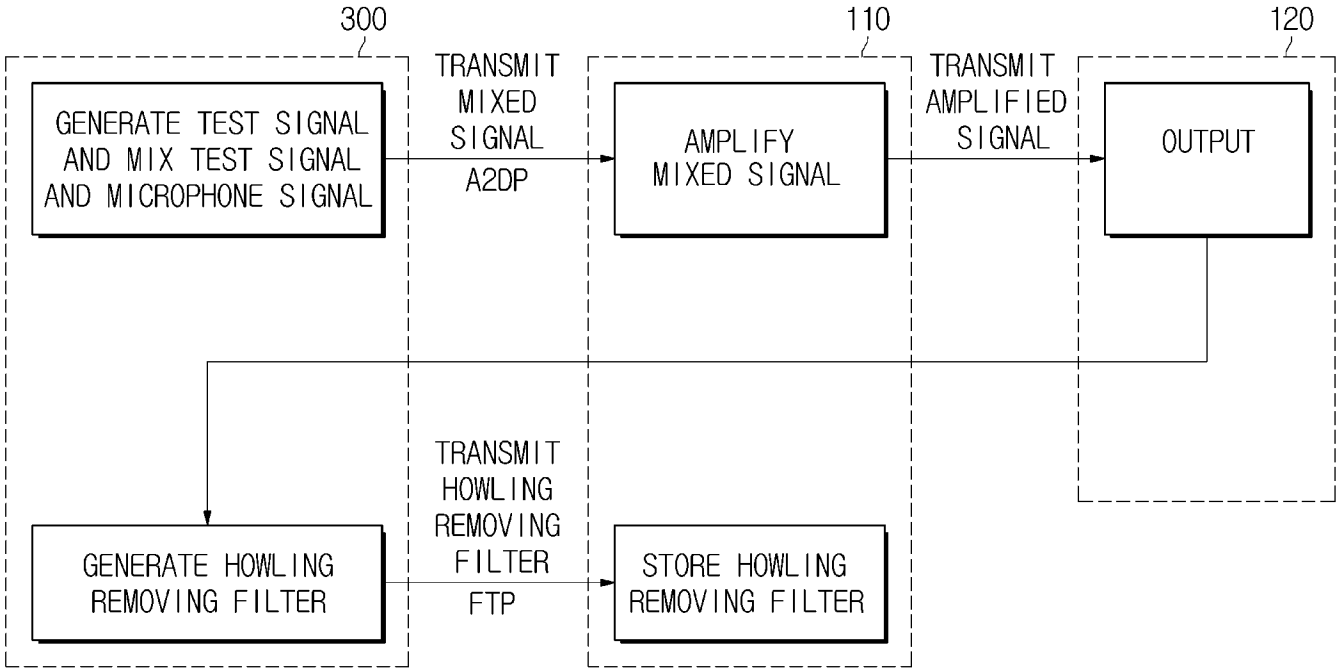

FIG. 17 is a flowchart illustrating generation of the sound feedback removing filter and illustrates a case in which a sound is input using the terminal.

The terminal 300 generates a test signal, generates a microphone signal of the microphone that is provided therein, mixes the microphone signal and the test signal, and transmits the mixed signal that is mixed to the audio device using the second profile (A2DP). When the mixed signal is received, the main body 110 of the audio device amplifies the received mixed signal to a predetermined size and transmits the amplified signal to the speaker 120. The speaker 120 outputs the received signal.

In this case, the sound signal output from the speaker is input to the microphone of the terminal 300 as a feedback signal. The terminal 300 generates the sound feedback removing filter using the received feedback signal and transmits the generated sound feedback removing filter to the main body of the audio device using the third profile (FTP). The audio device stores the received sound feedback removing filter.

Figure 18:
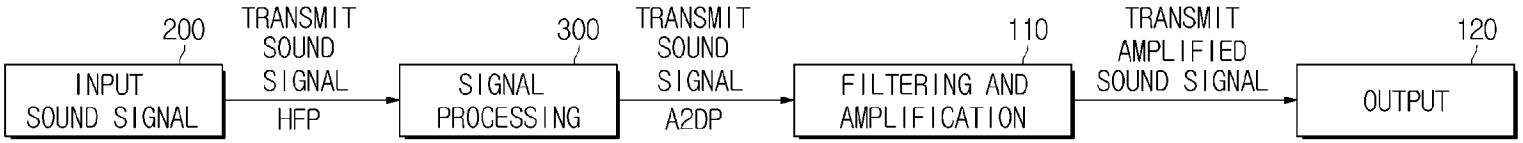

FIG. 18 is a flowchart illustrating the speech mode and illustrates a case in which the sound feedback removing filter is stored in the audio device. This may be identified according to an input of the selection copy button.

The hands-free device 200 receives the user's sound through the microphone and transmits a sound signal of the received sound to the terminal 300 using the first profile (HFP). The terminal 300 performs signal processing on the received sound signal and transmits the signal-processed sound signal to the main body 110 of the audio device using the second profile (A2DP).

The main body 110 of the audio device filters the signal-processed sound signal using the sound feedback removing filter, amplifies the sound signal in which a sound feedback frequency is filtered to a predetermined size, and transmits the amplified sound signal to the speaker 120. The speaker 120 outputs the received sound signal.

Figure 19:
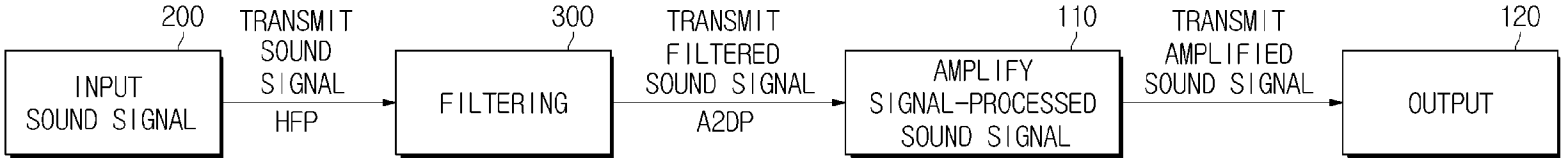

FIG. 19 is a flowchart illustrating the speech mode and illustrates a case in which a program for performing filtering of the sound feedback removing filter is stored in the terminal. This may be confirmed according to an input of the selection application button.

The hands-free device 200 receives the user's sound through the microphone and transmits a sound signal of the received sound to the terminal 300 using the first profile (HFP). The terminal 300 performs signal processing on the received sound signal, filters the signal-processed sound signal using the sound feedback removing filter, and transmits the sound signal in which a sound feedback frequency is filtered to the main body 110 of the audio device using the second profile (A2DP).

The main body 110 of the audio device amplifies the filtered sound signal to a predetermined size and transmits the amplified sound signal to the speaker 120. The speaker 120 outputs the received sound signal. In this manner, since the audio device may output the sound signal in which a sound feedback frequency is removed, it is possible to improve a sound delivery effect.

According to the present disclosure, a sound feedback removing filter corresponding to an environment of a place in which speech is produced is generated, and when speech is produced in the place in which speech is produced using a microphone, a sound feedback frequency of a sound signal is removed using a sound feedback removing filter and a sound signal in which a sound feedback frequency is removed is output. Therefore, it is possible to accurately deliver a speaker's sound. That is, it is possible to increase accuracy of delivery of the speaker's sound.

Also, according to the present disclosure, it is possible to generate the sound feedback removing filter that is optimized to the environment of the place in which speech is produced, and thus, a volume level of the microphone can be adjusted to a maximum volume level. Since one hands-free device may be used as a microphone for an announcement or a microphone for a call, there is no need to keep several hands-free devices. Therefore, it is possible to decrease a cost of the hands-free device. Furthermore, since the hands-free device may be used as a wireless microphone rather than a wired microphone, the user may easily use it while moving in the vehicle. Since a cord of the microphone is removed, an internal environment of the vehicle can be more organized and improved and it is possible to decrease a cost due to cord removal.

What is claimed is:

1. A terminal, comprising:

a communication unit configured to communicate with a hands-free device and an audio device provided in a place in which speech is produced; and a control unit configured to pair with the hands-free device using a hands-free profile (HFP), pair with the audio device using an advanced audio distribution profile (A2DP) and a file transfer profile (FTP), and perform control such that: i) when a filter generation mode is selected, a test signal is generated, ii) when a microphone signal transmitted from the hands-free device is received through the HFP, the received microphone signal and the generated test signal are mixed, and the mixed signal is transmitted to the audio device using the A2DP, and iii) when a feedback signal transmitted from the hands-free device is received, a sound feedback removing filter is generated based on the received feedback signal, and the generated sound feedback removing filter is transmitted to the audio device using the FTP.

2. The terminal according to claim 1, wherein:

the control unit is further configured to convert the feedback signal into a level of a frequency domain, compare the converted level to a reference level, identify at least one frequency whose converted level is the reference level or greater, and generate the sound feedback removing filter based on the at least one identified frequency.

3. The terminal according to claim 2, further comprising:

an input unit configured to receive a selection of the filter generation mode; and a sound input unit configured to receive a sound signal in the place in which speech is produced, wherein the control unit is further configured to perform control such that: i) when the filter generation mode is selected, it is determined whether the microphone signal and a sound signal transmitted from the hands-free device are received, ii) when it is determined that the microphone signal and the sound signal are received, the received microphone signal and sound signal are mixed, and the mixed signal is transmitted to the audio device, and iii) when the feedback signal transmitted from the hands-free device is received, the sound feedback removing filter is generated based on the received feedback signal.

4. The terminal according to claim 1, further comprising:

a storage unit configured to store the generated sound feedback removing filter and store, by mapping, a generation time of the sound feedback removing filter and a name of the place in which speech is produced.

5. A terminal, comprising:

a communication unit configured to communicate with a hands-free device and an audio device provided in a place in which speech is produced;

a control unit configured to pair with the hands-free device using a hands-free profile (HFP), pair with the audio device using an advanced audio distribution profile (A2DP), and perform control such that: i) when a filter generation mode is selected, a test signal is generated, ii) when a microphone signal transmitted from the hands-free device is received through the HFP, the received microphone signal and the generated test signal are mixed, and the mixed signal is transmitted to the audio device using the A2DP, iii) when a feedback signal transmitted from the hands-free device is received, a sound feedback removing filter is generated based on the received feedback signal, and iv) when a speech mode is selected, filtering of the sound signal transmitted from the hands-free device is performed using the sound feedback removing filter, and the filtered sound signal is transmitted to the audio device using the A2DP; and a storage unit configured to store the sound feedback removing filter.

6. The terminal according to claim 5, wherein:

the control unit is further configured to convert the feedback signal into a level of a frequency domain, compare the converted level to a reference level, identify a frequency whose converted level is the reference level or greater, and generate the sound feedback removing filter using the identified frequency.

7. A terminal, comprising:

a communication unit configured to communicate with an audio device provided in a place in which speech is produced;

a sound input unit configured to receive a sound signal in the place in which speech is produced; and a control unit configured to pair with the audio device using an advanced audio distribution profile (A2DP) and a file transfer profile (FTP), and perform control such that: i) when a filter generation mode is selected, a test signal is generated, a microphone signal and the generated test signal are mixed, and the mixed signal is transmitted to the audio device using the A2DP, and ii) when a feedback signal is received in the sound input unit, a sound feedback removing filter is generated based on the received feedback signal, and the generated sound feedback removing filter is transmitted to the audio device using the FTP.

8. The terminal according to claim 7, wherein:

the control unit is further configured to convert the feedback signal into a level of a frequency domain, compare the converted level to a reference level, identify at least one frequency whose converted level is the reference level or greater, and generate the sound feedback removing filter base on the at least one identified frequency.

9. An audio device, comprising:

a communication unit configured to communicate with a terminal in a place in which speech is produced;

a control unit configured to pair with the terminal using an advanced audio distribution profile (A2DP) and a file transfer profile (FTP), and perform control such that: i) when a mixed signal transmitted from the terminal in a filter generation mode is received using the A2DP, an output of the mixed signal is controlled, and storage of a sound feedback removing filter transmitted through the FTP is controlled, and ii) when a sound signal transmitted from the terminal in a speech mode is received through the A2DP, filtering of the received sound signal is performed using the stored sound feedback removing filter, and an output of the filtered sound signal is controlled;

a storage unit configured to store the sound feedback removing filter;

an amplification unit configured to amplify the mixed signal and the sound signal; and a speaker configured to output the amplified mixed signal and sound signal.

* * * * *